US005416981A

United States Patent [19]

Yeh

[11] Patent Number: 5,416,981

[45] Date of Patent: May 23, 1995

[54] DEHUMIDIFYING MACHINE FOR DEHYDRATING MATERIALS

[76] Inventor: Ching-Shui Yeh, 3F, No. 338-2, Har-Erh-Pin St., San-Min Dist., Kaohsiung City, Taiwan, Prov. of China

[21] Appl. No.: 143,287

[22] Filed: Oct. 26, 1993

[51] Int. Cl.[6] ..... B05C 15/00

[52] U.S. Cl. ..... 62/218; 34/82; 34/231; 34/480

[58] Field of Search ..... 34/82, 218, 219, 231, 34/480

[56] References Cited

U.S. PATENT DOCUMENTS

| | | | |
|---|---|---|---|
| 2,351,482 | 6/1944 | Campbell | 34/218 |
| 3,307,272 | 3/1967 | Maynard | 34/219 |
| 3,413,728 | 12/1968 | Tiegel et al. | 34/219 |
| 4,011,663 | 3/1977 | Moyer | 34/219 |

*Primary Examiner*—Ronald C. Capossela
*Attorney, Agent, or Firm*—Christensen, O'Connor, Johnson & Kindness

[57] ABSTRACT

A dehumidifying machine is used for dehydrating materials and includes a tank used for depositing the materials therein, a draft tube system which has an inlet portion and an outlet portion communicated with the tank, an induced draft fan which is mounted in the draft tube system between the inlet and outlet portions and which has an inhaling portion and an exhaling portion so as to circulate the air in the dehumidifying machine, and a heating device mounted in the draft tube system in order to heat the air, which is exhaled from the outlet portion of the draft tube system into the tank so as to dehydrate the materials. The dehumidifying machine further includes a filter device which is mounted in the draft tube system near the inlet portion so as to block impurities carried in the air from moving into the heat device and the tank.

3 Claims, 4 Drawing Sheets

DEHUMIDIFYING MACHINE FOR DEHYDRATING MATERIALS

BACKGROUND OF THE INVENTION

1. Field of the Invention

This invention relates to a dehumidifying machine for dehydrating materials, more particularly to a dehumidifying machine which can dehydrate effectively materials and which has a filter device mounted therein so as to prevent the materials from being polluted.

2. Description of the Related Art

Referring to FIG. 1, a conventional dehumidifying machine includes a tank 11 which is used to receive some materials, an induced draft fan 13 which is mounted on the top side of the tank 11, an annular separating plate 12 which extends downward from the central section of the top surface of the tank 11 so as to divide the tank 11 into an outside portion 113 and an inside portion 112, and a heating device 10 disposed in the inside portion 112 of the tank 11. The induced draft fan 13 has two inlet portions 131 which are communicated with the outside portion 113 of the tank 11, and an outlet portion 132 which is communicated with the inside portion 112 of the tank 11. The separating plate 12 has a plurality of holes 121 formed therein so as to allow air to move through the separating plate 12. The tank 11 has two filter plates 111, each of which is positioned between the interengaging surfaces of the outside portion 113 and the inlet portion 111.

When the dehumidifying machine is actuated, air can be moved from the outlet portion 132 of the induced draft fan 13 into the inside portion 112 of the tank 11 so that the air can be heated by the heating device 10. At this time, the heated air can move through the holes 121 of the separating plate 12 into the outside portion 113 of the tank 11 so as to heat the materials in the outside portion 113 of the tank 11, thereby dehydrating the materials. In addition, when the air is exhausted from the inlet portions 131 of the induced draft fan 13, the filter plates 111 can block the impurities carried in the air from moving into the induced draft fan 13.

The drawbacks of this conventional dehumidifying machine are as follows:

1. Because the distances between the heating device 10 and the vertically spaced portions of the separating plate 12 are different, the heated air moving through the holes 121 at the lower and upper portions of the separating plate 12 has different temperatures. Accordingly, the materials in the outside portion 113 of the tank 11 cannot be dehydrated evenly.

2. Some tiny impurities, such as dyestuffs and the like, mixed with the materials may move through the holes 121 and coat on the heating device 10 and thus be burned to produce smoke which may stain the materials.

3. When some impurities carried in the air are deposited on the filter plates 111, it is quite difficult to clean the filter plates 111 by taking off the top cover of the tank 11.

SUMMARY OF THE INVENTION

The main objective of this invention is to provide a dehumidifying machine which can dehydrate effectively materials and which has a filter device mounted therein so as to prevent the materials from being polluted.

According to this invention, a dehumidifying machine is used for dehydrating materials and includes a tank used for depositing the materials therein, a draft tube system which has an inlet portion and an outlet portion communicated with the tank, an induced draft fan which is mounted in the draft tube system between the inlet and outlet portions and which has an inhaling portion and an exhaling portion so as to circulate the air in the dehumidifying machine, and a heating device mounted in the draft tube system in order to heat the air which is exhaled from the outlet portion of the draft tube system into the tank so as to dehydrate the materials. The dehumidifying machine further includes a filter device which is mounted in the draft tube system near the inlet portion so as to block impurities carried in the air from moving into the heat device and the tank.

BRIEF DESCRIPTION OF THE DRAWING

Other features and advantages of this invention will become apparent in the following detailed description of a preferred embodiment of this invention, with reference to the accompanying drawing, in which.

DETAILED DESCRIPTION OF THE PREFERRED EMBODIMENT

Figure 1:
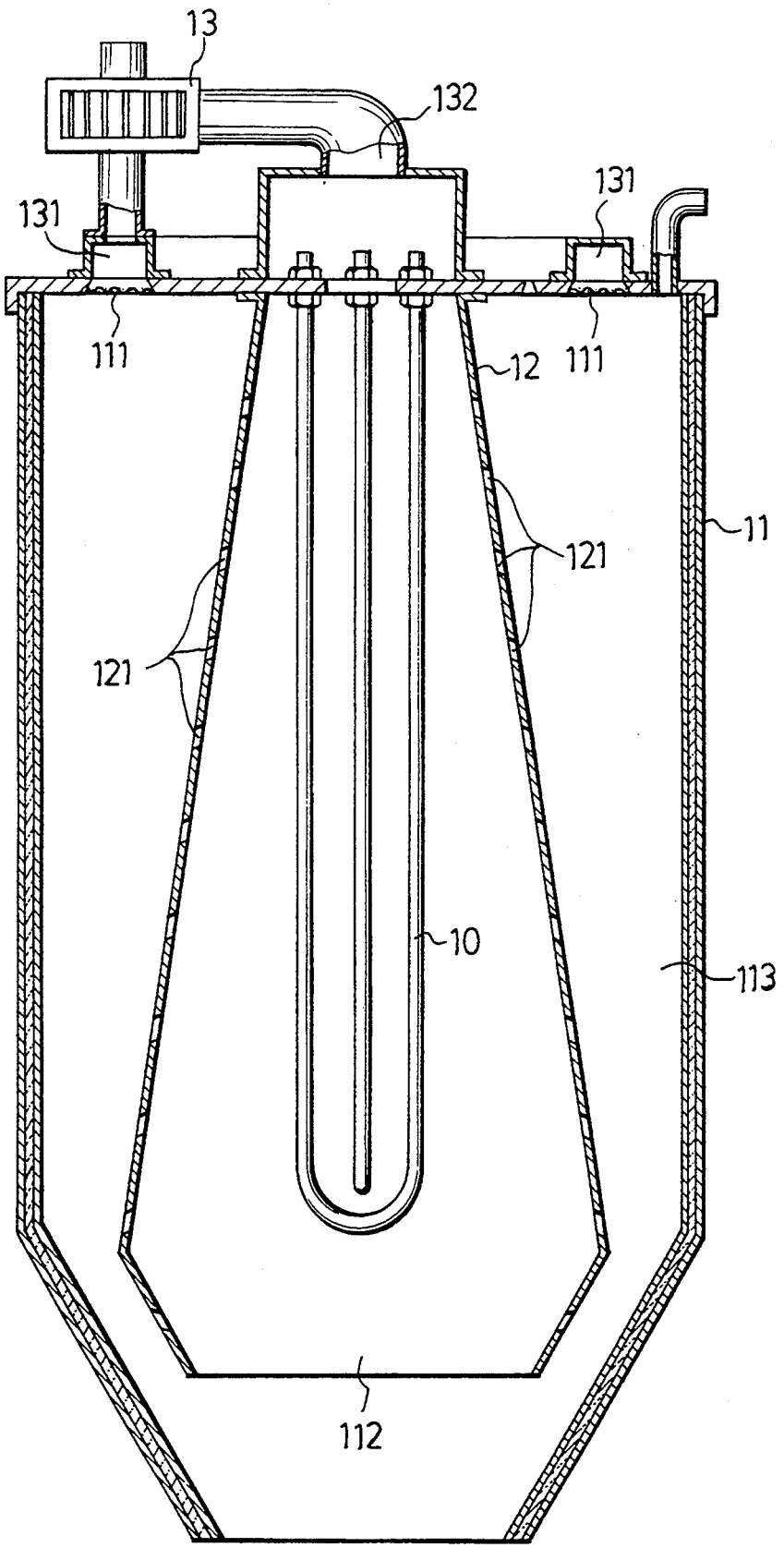
FIG. 1 (PRIOR ART)
FIG. 1 is a schematic view of a conventional dehumidifying machine.
Figure 2:
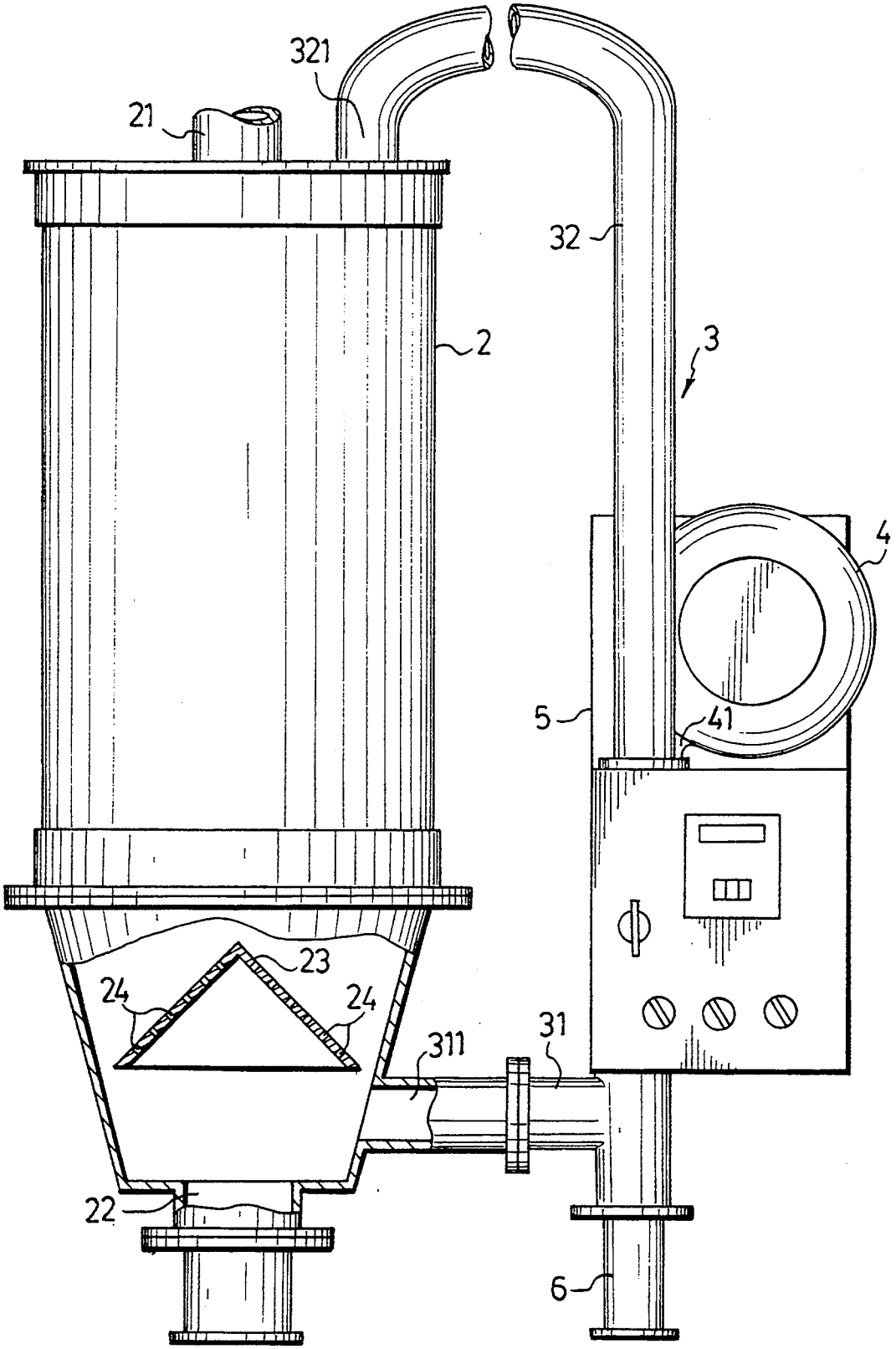
FIG. 2 is a schematic view of a dehumidifying machine in accordance with the preferred embodiment of this invention.

Referring to FIG. 2, a dehumidifying machine of the preferred embodiment of this invention is used for dehydrating materials and includes a tank 2, a draft tube system 3, an induced draft fan 4, a filter device 5, and a heating device 6.

The tank 2 is used for depositing materials therein so as to dehydrate the same and includes an inlet portion 21 at the top side of the tank 2, an outlet portion 22 at the bottom side of the tank 2, and an inverted V-shaped guide plate 23 located above the outlet portion 22 so that, when poured into the tank 2, the materials fall on the inclined upper surfaces of the guide plate 23 to the outlet portion 22. The guide plate 23 has several holes 24 formed therein.

The draft tube system 3 is communicated with the bottom and top sides of the tank 2 and includes a supply pipe 31, an outlet portion 311 which communicates the supply pipe 31 to the bottom side of the tank 2, a return pipe 32, and an inlet portion 321 which communicates the return pipe 32 to the top side of the tank 2.

Figure 4:
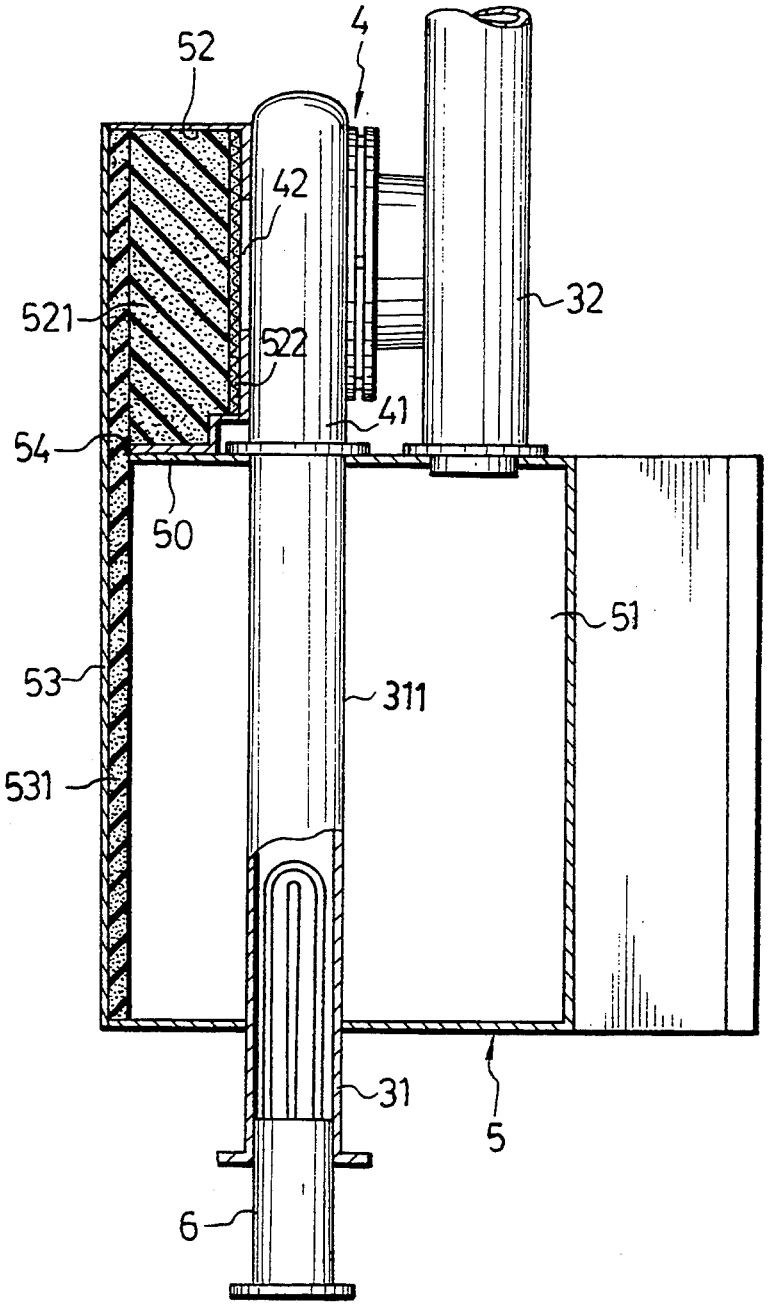
FIG. 4 is a schematic view showing the filter device of the dehumidifying machine of the preferred embodiment of this invention.

The induced draft fan 4 is mounted in the draft tube system 3 and has an exhaling portion 41 which is communicated with the supply pipe 31 of the draft tube system 3, and an inhaling portion 42 which is communicated with the return pipe 32 via the filter device 5, as shown in FIG. 4, so as to circulate air in the dehumidifying machine.

The heating device 6 is mounted in the supply pipe 31 of the draft tube system 3, as shown in FIG. 4, in order to heat the air exhaled from the induced draft fan 4. The heated air is exhaled from the outlet portion 311 of the draft tube system 3 into the tank 2 and thus flows upward and evenly through the holes 24 of the guide plate 23 so as to dehydrate the materials on the upper surfaces of the guide plate 23. Then, the dehydrated materials fall along the guide plate 23 to the outlet portion 22 of the tank 2.

Figure 3:
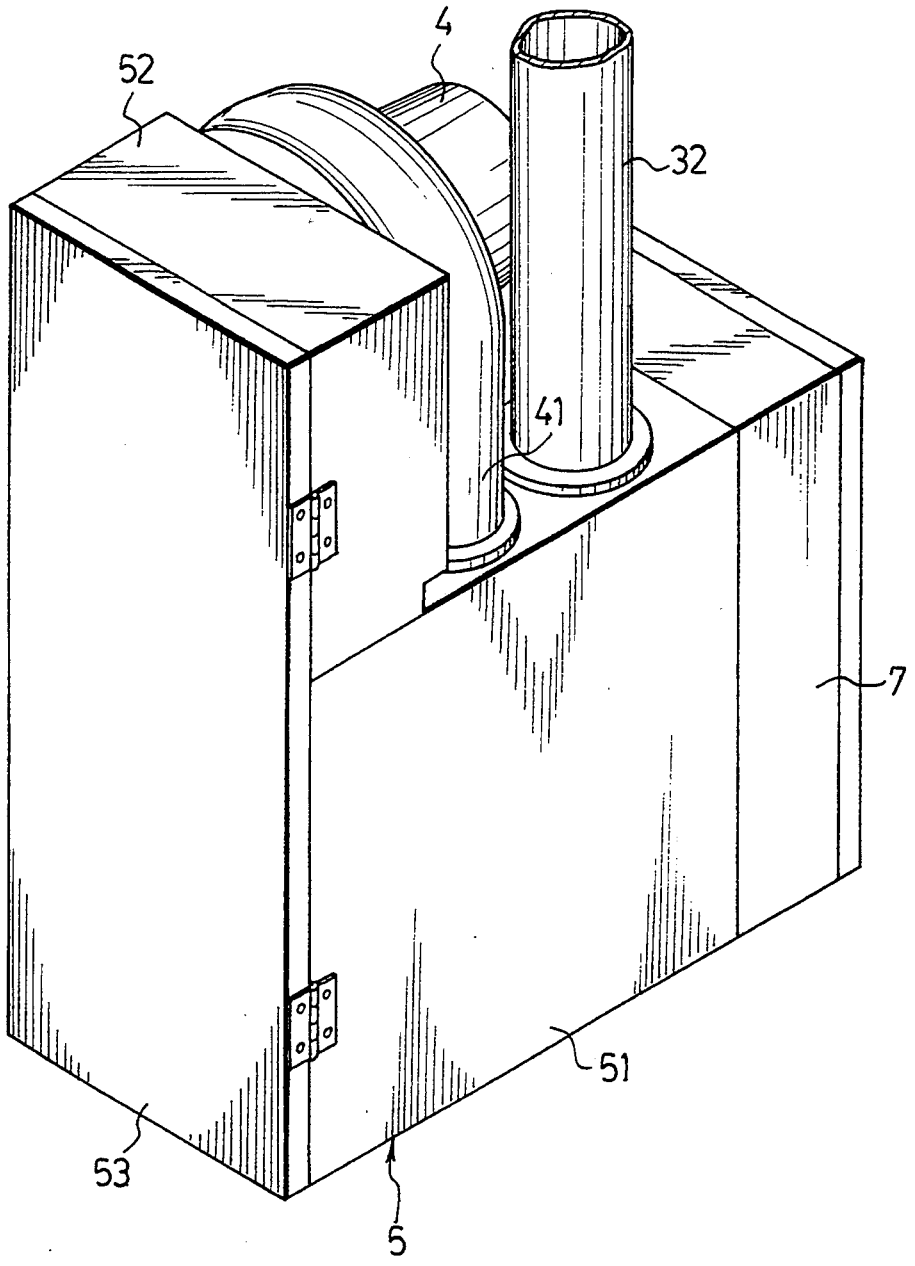
FIG. 3 is an perspective view showing the filter device of the dehumidifying machine according to the preferred embodiment of this invention.

Referring to FIGS. 3 and 4, the filter device 5 is a chest body and includes a separating plate 50 which divides the chest body into an upper section and a lower section, a depositing chamber 51 which is located at the lower section of the chest body, a filter chamber 52 which is located at the upper section of the chest body, a door 53 which is mounted pivotally on the left side of the chest body so as to permit opening of the door 53 when cleaning the filter device 5, and an air passage 54 which is formed between the door 53 and the separating plate 50 and which intercommunicates the upper and lower sections of the chest body so that air can move from the depositing chamber 51 to the filter chamber 52 via the air passage 54. The depositing chamber 51 is communicated with the return pipe 32 so as to deposit the larger impurities carried in the air when the air is exhaled from the return pipe 32. The filter chamber 52 intercommunicates the depositing chamber 51 and the inhaling portion 42 of the induced draft fan 4 in order to filter the tinier impurities carried in the air. A set of filter elements 521 are filled in the filter chamber 52. Another set of filter elements 531 are coated on the inner side wall of the door 53 so as to fill the air passage 54. A filter net 522 is positioned between the inhaling portion 42 of the induced draft fan 4 and the filter elements 521 so as to prevent the impurities carried in air from being inhaled into the induced draft fan 4. The filter elements 521, 531 are made of non-woven fabric. Accordingly, the filter device 5 can filter effectively impurities carried in air so as to prevent the impurities from staining the induced draft fan 4 and the heat device 6, thereby preventing the pollution of the materials which are to be dehydrated. Preferably, the supply pipe 31 of the draft tube system 3 has an intermediate section 311 which extends through the depositing chamber 51 of the filter device 5 so that, when moving through the depositing chamber 51 from the return pipe 32, the air in the depositing chamber 51 can preheat the supply pipe 31.

Referring again to FIG. 3, the dehumidifying machine of this invention further includes a controlling device 7 which is mounted on one side of the chest body of the filter device 5. The controlling device 7 has an electric circuit which is used for operating the dehumidifying machine in a known manner.

The advantages of the dehumidifying machine of this invention are as follows:

1. With the filter device 5 interposed between the tank 2 and the fan 4, the dehumidifying machine is capable of filtering effectively impurities carried in air so as to prevent the materials from being polluted and to prevent the induced draft fan 4 and the heat device 6 from being stained.

2. The heated air flowing upward from the bottom side of the guide plate 23 via the holes 24 can heat evenly the materials when the materials fall on the upper surfaces of the guide plate 23.

3. The door 53 of the filter device 5 can be opened in order to take the filter elements 522, 521 out and clean the same.

With this invention thus explained, it is apparent that numerous modifications and variations can be made without departing from the scope and spirit of this invention. It is therefore intended that this invention be limited only as indicated in the appended claims.

I claim:

1. A dehumidifying machine for dehydrating materials, including a tank used for depositing said materials therein, the dehumidifying machine comprising:

(a) a draft tube system comprising:

(i) an inlet portion in communication with a bottom side of the tank, (ii) an outlet portion in communication with a top side of the tank, (iii) an induced draft fan mounted in said draft tube system between said inlet and outlet portions, the fan having an exhaling portion and an inhaling portion so as to circulate said air in said dehumidifying machine, the exhaling portion of the fan intercommunicated with the outlet portion of the draft tube system by a supply pipe, and (iv) a heating device mounted in the supply pipe of the the draft tube system in order to heat the air which is exhaled from said outlet portion of the draft tube system into said tank so as to dehydrate said materials, (b) a filter device mounted near the inlet portion of the draft tube system, the filter comprising:

(i) a depositing chamber in communication, through a return pipe of the draft tube system, with the inhaling portion of the draft fan;

(ii) a filter chamber intercommunicated with the depositing chamber and the inhaling portion of the induced draft fan;

(iii) filter elements within said filter chamber; and (iv) a filter net between the filter chamber and the inhaling portion of the induced draft fan to prevent impurities in said air from being inhaled into the induced draft fan.

2. A dehumidifying machine as claimed in claim 1, wherein said filter device comprises a chest body including a separating plate dividing said chest body into an upper section and a lower section, said upper and lower sections of said chest body being respectively provided for said filter and deposit chambers, said chest body comprising a door mounted pivotally on one side of said chest body for opening when cleaning said filter device; an air passage formed between said door and said separating plate of chest body intercommunicating said upper and lower sections of said chest body; and several filter elements coated on an inner side wall of said door to fill in said air passage.

3. A dehumidifying machine as claimed in claim 1 wherein said supply pipe of said draft tube system has an intermediate section extending through said depositing chamber of said filter device so that, when moving through said depositing chamber from said return pipe, air in said deposition chamber can preheat said supply pipe.

* * * * *